US005305494A

United States Patent [19]

Candler

[11] Patent Number: 5,305,494

[45] Date of Patent: Apr. 26, 1994

[54] AIRBRUSH VACUUM SYSTEM

[76] Inventor: Teresa Candler, 1202 Tiffany La. #C, Myrtle Beach, S.C. 29557

[21] Appl. No.: 27,671

[22] Filed: Mar. 8, 1993

[51] Int. Cl.[5] ..... A47L 7/00

[52] U.S. Cl. ..... 15/304; 15/310; 15/395; 55/385.1; 55/467; 118/326

[58] Field of Search ..... 454/49; 118/326; 55/383, 385.1, 467; 15/301, 304, 310, 395

[56] References Cited

U.S. PATENT DOCUMENTS

| | | | |
|---|---|---|---|
| 690,746 | 1/1902 | Lundeberg . | |
| 2,106,187 | 1/1938 | Naugler | 118/326 X |
| 2,170,528 | 8/1939 | Gibbons | 15/310 X |
| 2,621,755 | 12/1952 | Gray, Jr. | 55/467 X |
| 3,811,371 | 5/1974 | Hardy | 118/326 X |
| 4,020,789 | 5/1977 | Gamvrellis | 118/308 |
| 4,113,454 | 9/1978 | Cvacho | 55/467 X |
| 4,218,963 | 8/1980 | Burnetter | 454/49 |
| 4,550,679 | 11/1985 | Pipa et al. | 118/326 X |
| 4,567,064 | 1/1986 | Woste | 118/326 X |

FOREIGN PATENT DOCUMENTS

| | | | |
|---|---|---|---|
| 2068107 | 8/1981 | United Kingdom | 454/49 |

*Primary Examiner*—Harvey C. Hornsby
*Assistant Examiner*—Charles Cooley
*Attorney, Agent, or Firm*—Rhodes, Coats & Bennett

[57] ABSTRACT

An airbrush vacuum system for removing paint particulate from the air that results from an airbrush painting operation. The airbrush paint vacuum system includes a vacuum chamber designed to fit interiorally of the garment being painted. A vacuum source is connected to the vacuum chamber, and in operation, a vacuum is generated in the vacuum chamber. This vacuum results in paint particulate being induced from the surrounding air through the garment itself into the vacuum chamber. Thereafter, the captured paint particulate is conveyed to a collection area.

13 Claims, 2 Drawing Sheets

AIRBRUSH VACUUM SYSTEM

FIELD OF THE INVENTION

The present invention relates generally to airbrush painting, and more particularly to a vacuum system for removing paint particulate during an airbrush painting operation.

BACKGROUND OF THE INVENTION

Airbrush painting shirts and other garments is very popular and is performed by artists all over the country. To airbrush a garment, an artist positions a garment over a board having a perforated screen. The artist then uses an airbrush to direct paint from a nozzle on the airbrush through the air and onto the garment. By maneuvering the airbrush, the artist is able to create original, custom-made designs for a customer. Because the customer and others are able to watch the creative steps of producing an airbrush shirt, the creative process of the artist is typically very entertaining to onlookers. Artist often perform airbrush painting in public places to entertain people passing by and also frequently relocate their airbrush equipment to different locations to give different groups of people an opportunity to purchase an airbrush shirt or other garment while being entertained.

One important problem of airbrush painting is that during the airbrushing of a garment, paint particulate or paint vapor become mixed with the air. These paint particles in the air can adversely affect the health of the airbrush artist and onlookers who may breath in to their lungs the paint particles. In particular, the artist who is continuously airbrushing shirts and other garments is particularly at risk to health problems developing from inhaling paint particles over an extended time period.

No effective solution to the problems associated with paint particles being placed in the air by the air brush has been developed. Some airbrush artists do wear masks over their nose and mouth to help prevent inhaling paint vapor or particles. However, the masks are uncomfortable to an artist. In addition, the masks are unsightly and detract from the entertainment value by making it difficult for the artist to talk with /nlookers as airbrushing is being performed. Fans and vents are also used to help prevent paint particles from being inhaled. However, fans and vents are not very effective and are unsightly. In addition, the fans and vents are not very portable and make it more difficult for an airbrush artist to change locations.

The problem of paint particles being placed in the air during other painting situations has been recognized in the prior art. For example, the following references disclose mechanisms for removing paint particles from the air: U.S. Pat. No. 690,746 issued Jan. 7, 1902 to Lundeburg; U.S. Pat. No. 3,811,371, issued on May 21, 1974 to Hardy; U.S. Pat. No. 4,020,789 issued on May 3, 1977 to Gamvrellis; U.S. Pat. No. 4,550,679, issued on Nov. 5, 1985 to Pipa et al; U.S. Pat. No. 4,567,064, issued on Jan. 28, 1986 to Wüst. There has never, however, been any vacuum system effectively designed for airbrush painting. There is a need for an airbrush vacuum system that helps prevent paint particles from being inhaled and that is easily portable and not unsightly.

SUMMARY OF THE INVENTION

The present invention is a portable airbrush vacuum system used during airbrush painting to help protect an airbrush artist and others from inhaling paint particles. The airbrush vacuum system is easy to handle and does not interfere with the painting techniques of an airbrush artist.

The airbrush vacuum system of the present invention includes a vacuum chamber designed to fit inside the garment being airbrushed. A vacuum is drawn on the vacuum chamber and paint is directed at and through the garment being airbrushed into the vacuum chamber. The compact design of the vacuum chamber enables an artist to easily relocate to a different location.

It is therefore an object of the present invention to provide a highly portable airbrush vacuum system for use during airbrush painting of garments.

Another object of the present invention is to provide a airbrush vacuum system having a compact design.

Another object of the present invention is to provide a highly efficient and effective system to remove paint particles from the air to protect an airbrush artist and /nlookers from inhaling paint particles.

Other objects and advantages of the present invention will become apparent and obvious from a study of the following description and the accompanying drawings which are merely illustrative of such invention.

DETAILED DESCRIPTION OF THE INVENTION

Figure 1:
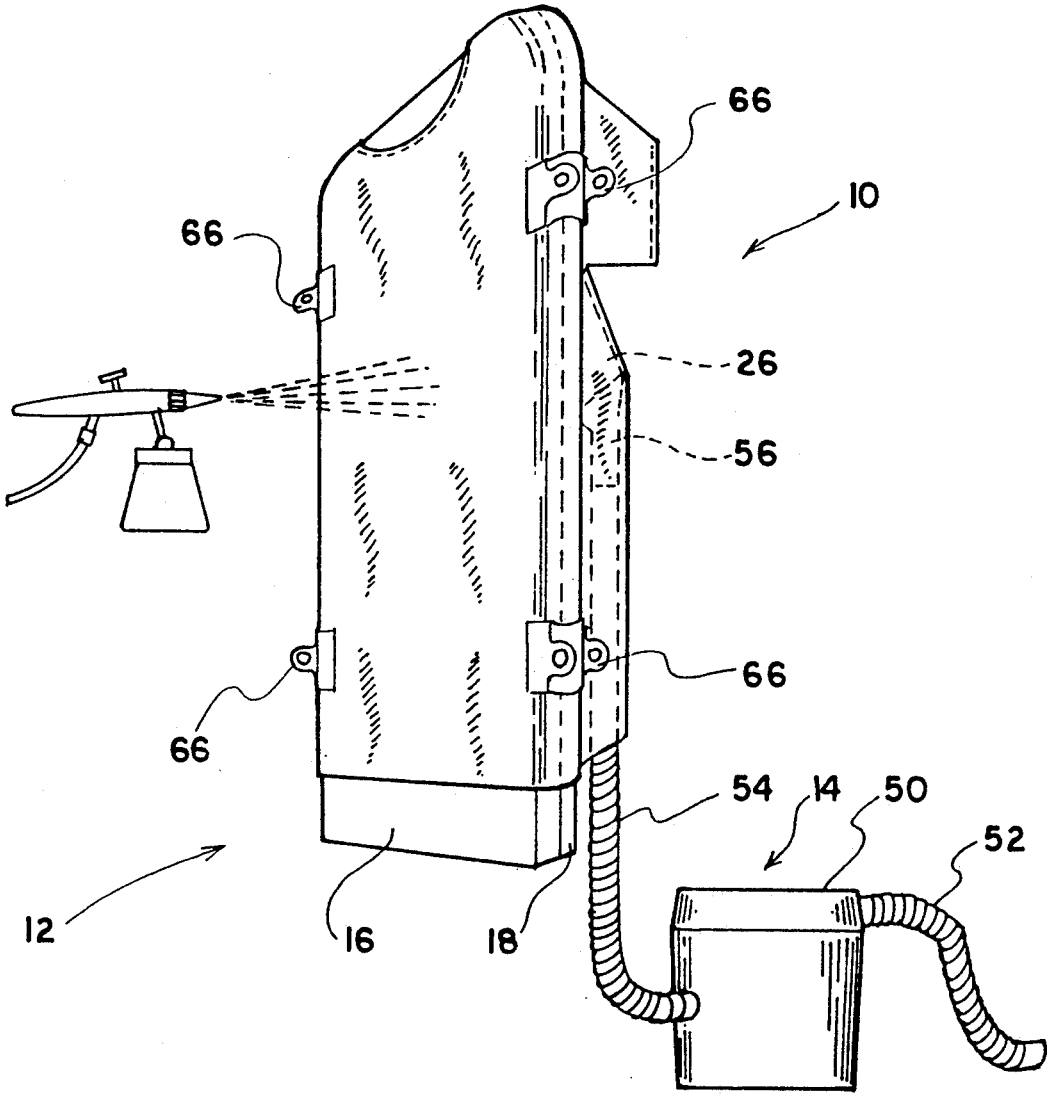
FIG. 1 is a perspective view of the airbrush vacuum system of the present invention in operation.

With further reference to the drawings, the present invention is an airbrush vacuum system that is indicated generally by the numeral 10. Airbrush vacuum system 10 is used to remove paint particles from the air surrounding the airbrush garment painting operation. Airbrush vacuum system 10 includes a vacuum chamber 12 positionable inside a garment to be airbrushed and a vacuum means 14 for drawing a vacuum in the vacuum chamber 12. Vacuum chamber 12 draws paint from an airbrush through a shirt overlying vacuum chamber 12 and into the vacuum chamber 12 so as to prevent paint particles from going into the air surrounding an airbrush garment painting operation.

Vacuum chamber 12 includes a front panel 16 and a back panel 18 connected together to form a vacuum chamber area 20 disposed therebetween. Front panel 16 has a perforated screen 22 extending over an opening in front panel 16. Perforated screen 22 is fastened to front panel 16 with staples, glue or other similar fastener means. Back panel 18 has an outlet 24 formed therein that leads to vacuum chamber area 20. Front and back panels 16 and 18 are connected together with an epoxy-type glue such that the vacuum chamber area 20 is formed between perforated screen 22 and back panel 18.

Figure 2:
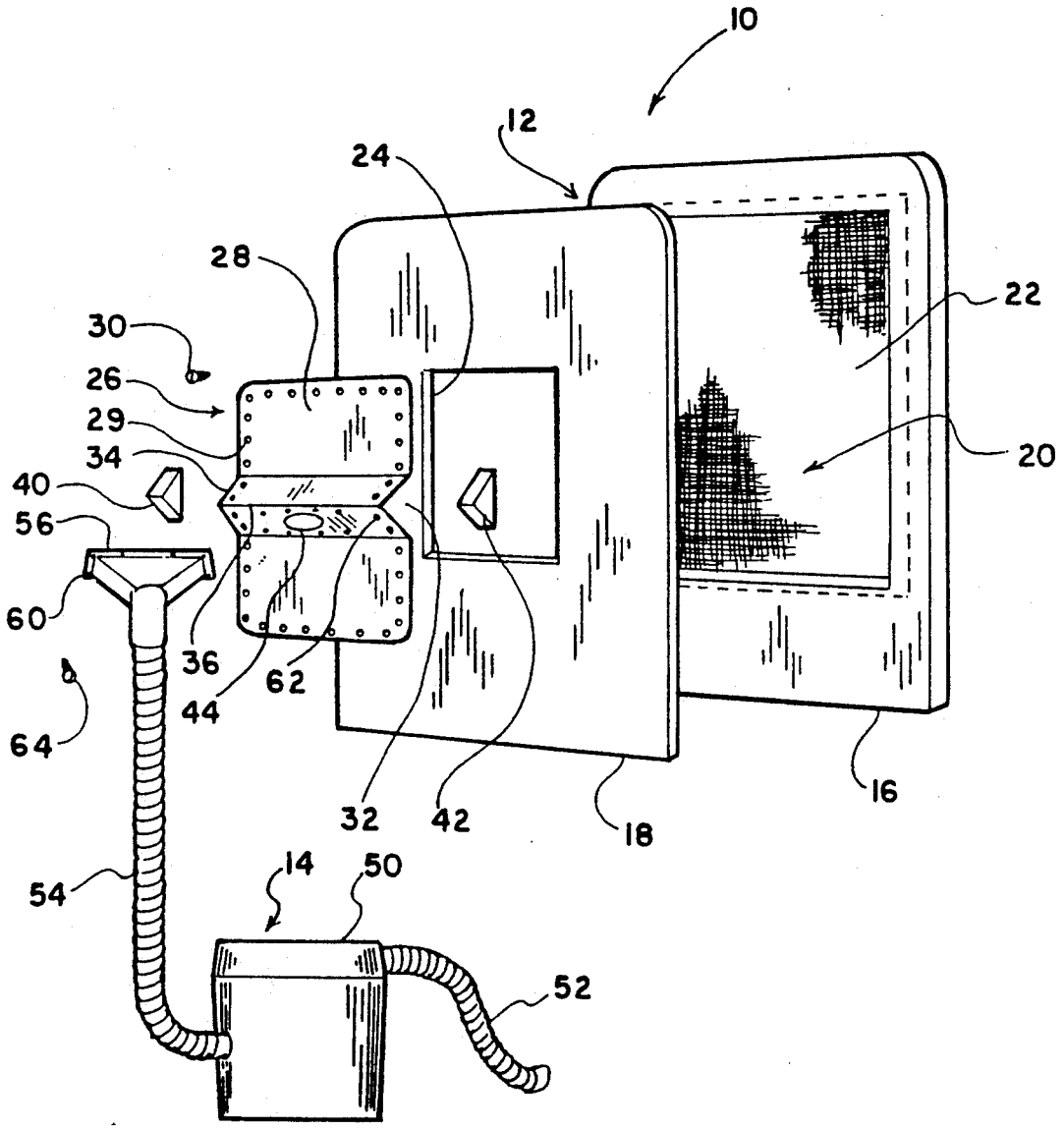
FIG. 2 is an exploded, perspective view of the airbrush vacuum system of the present invention.

Referring to FIG. 2, positioned over back panel 18 is an adapter shown generally by the numeral 26. Adapter 26 includes a plate structure 28 having spaced fastener openings 29 positioned around a border area of the plate structure 28. Plate screws 30 extend through fastener openings 29 to affix adapter 26 over outlet 24 of back panel 18. Adapter 26 further includes opposed end portions 32 and 34 and an intermediate V-channel 36 extending therebetween. V-channel plugs 40 and 42 fit into /pposed end portions 32 and 34 and are guled into portion. A V-channel opening 44 is formed in the plate structure 28 between opposed end portions 32. Outlet 24 of back panel 18 and V-channel opening 44 are positioned adjacent to a center portion of perforated screen 22 to help ensure that an effective vacuum is drawn in vacuum chamber area 20.

Vacuum means 14 is connected to adapter 26 to produce the vacuum in vacuum chamber 12. Vacuum means 14 includes a vacuum source 50, an exhaust hose 52 and an inlet hose 54. Inlet hose 54 connects with a nozzle head 56. Nozzle head 56 is positioned over V-channel opening 44 and fixed to plate structure 28. Fastener openings 60 extend through nozzle head 56 and mate with opening 62 in the plate so as to enable fasteners 64 to affix nozzle head 56 to plate structure 28.

In operation, airbrush vacuum system 10 operates as follows. As shown in FIG. 1, a shirt is positioned over vacuum chamber 12 such that vacuum chamber 12 extends within the shirt. Clips 66 can be used to clamp the shirt onto vacuum chamber 12. A front portion of the clamped shirt extends over front panel 16 and perforated screen 22. A back portion of the shirt overlies back panel 18, adapter 26, and a section of inlet hose 54. With the shirt clamped to the vacuum chamber 12 in this manner, the vacuum source 50 is switched on and air from vacuum chamber area 20 is drawn through inlet hose 54 and into exhaust hose 52 where the drawn air is collected in an area remote from the air surrounding vacuum chamber 12. As air is drawn from vacuum chamber area 20, a suction is produced which causes air to be drawn through the shirt and adjacently positioned perforated screen 22 by the vacuum created by vacuum source 50.

Once vacuum source 50 has been turned on and the shirt positioned about vacuum chamber 12 as shown in FIG. 1, the airbrush painting can safely begin. Paint is directed at the shirt from an airbrush to place a painted design on the shirt. The vacuum in vacuum chamber area 20 causes a suction which draws paint particles through the shirt and adjacently positioned screen 22, and into vacuum chamber area 20. The paint particles and air in the vacuum chamber area 20 then travels to inlet hose 54 after passing through outlet 24 of back panel 18 and the V-channel opening 44 of adapter 26. The mixed air and paint particles travel from inlet hose 54, through vacuum source 50 and exhaust hose 52, to a collection area remotely located from the airbrush painting operation. By providing a vacuum chamber which pulls air and intermixed paint particules through the shirt being airbrushed, paint particles are removed from the air and airbrush painting of the shirt is not adversely effected. After use, airbrush artist can easily detach inlet hose 54 from adapter 26 and then easily relocate the airbrush vacuum system to another location.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. An integral garment board-vacuum system for removing overspray, fumes and vapor from the exterior of a garment while an area of the garment is being painted with an airbrush painting system, comprising:

(a) a garment board having a perforated screen and an integral vacuum chamber, the integral garment board and vacuum chamber being sized and dimensioned to fit inside a selected garment with the perforated screen positioned directly adjacent the painting area of the garment and the garment overlying and substantially surrounding the vacuum chamber;

(b) an outlet port formed in the integral garment board vacuum chamber; and (c) vacuum pump means connected to the outlet port for inducing overspray, paint fumes and vapor located outside the garment board and vacuum chamber through the garment, through the perforated screen, into the vacuum chamber and out the outlet port of the vacuum chamber so as to substantially remove overspray, paint fumes and vapor in the area around the exterior of the garment while the garment is being subjected to an airbrush painting operation.

2. The integral garment board-vacuum system of claim 1 including means for securing and retaining the garment around the garment board and vacuum chamber.

3. The integral garment board-vacuum system of claim 2 wherein the means for securing and retaining the garment around the garment board and vacuum chamber are a plurality of clips.

4. The integral garment board-vacuum system of claim 1 wherein the garment board further includes a frame structure having a front frame opening and a back panel detachably connected to the frame structure, and wherein the perforated screen overlies the frame opening and the outlet port of the vacuum chamber extends through the back panel such that the vacuum chamber produces a suction on the portion of the perforated screen overlying the frame opening causing the garment to be pulled against the perforated screen.

5. The integral garment board-vacuum system of claim 4 wherein the outlet port of the vacuum chamber is positioned adjacent to a center section of the perforated screen.

6. The integral garment board-vacuum system of claim 4 further including clips sized to clip over the connected frame structure and back panel so as to secure and retain the garment to the perforated screen and vacuum chamber.

7. The integral garment board-vacuum system of claim 1 further including a vacuum adapter secured within the outlet port said vacuum adapter including an opening for coupling the vacuum pump means to the vacuum chamber.

8. The integral garment board-vacuum system of claim 7 wherein the vacuum adapter includes a plate disposed over the outlet port.

9. The integral garment board-vacuum system of claim 8 wherein the /pening of the vacuum adapter is formed on a surface of the vacuum adapter which extends at an angle to the garment board.

10. A garment board for use in an airbrush painting system and for fitting within the interior of a garment to provide a planar background for a painting area of the garment to be airbrushed painted, comprising:

(a) a perforated screen placed within a garment and directly adjacent the painting area of the garment so as to form a planar background for the painting area of the garment;

(b) a vacuum chamber integral with the perforated screen and sized and dimensioned to fit inside the garment such that the garment substantially overlies and surrounds the vacuum chamber and the perforated screen; and (c) an outlet port formed in the vacuum chamber and connected to a vacuum pump for inducing overspray, paint fumes and vapor located outside the garment through the garment, through the perforated screen, into the vacuum chamber, and out of the outlet port of the vacuum chamber so as to substantially remove overspray, paint fumes, and vapor in the area around the exterior of the garment while the garment is being subjected to an airbrush painting operation.

11. The garment board of claim 10 including a plurality of clips for securing and retaining the garment around the vacuum chamber.

12. The garment board of claim 10 wherein the outlet port of the vacuum chamber is positioned adjacent to a center section of the perforated screen.

13. The garment board of claim 10 wherein the vacuum chamber further includes a frame structure having a front frame opening and a back panel detachably mounted to the frame structure, and wherein the perforated screen overlies the frame opening and the outlet port /f the integral garment board vacuum chamber extends through the back panel such that the vacuum chamber produces a suction on the portion of the perforated screen overlying the frame opening causing the garment to be pulled against the perforated screen.

* * * * *